US006315067B1

(12) United States Patent
Fielder

(10) Patent No.: US 6,315,067 B1
(45) Date of Patent: Nov. 13, 2001

(54) CUTTING ELEMENT WITH STRESS REDUCTION

(75) Inventor: Coy Michael Fielder, Cypress, TX (US)

(73) Assignee: Diamond Products International, Inc., Houston, TX (US)

( * ) Notice: Subject to any disclaimer, the term of this patent is extended or adjusted under 35 U.S.C. 154(b) by 0 days.

(21) Appl. No.: 09/391,033

(22) Filed: Sep. 7, 1999

Related U.S. Application Data

(63) Continuation-in-part of application No. 09/129,179, filed on Apr. 16, 1998, now Pat. No. 6,026,919.

(51) Int. Cl.[7] ..... E21B 10/12
(52) U.S. Cl. ..... 175/432; 175/432
(58) Field of Search ..... 175/428, 430–432

(56) References Cited

U.S. PATENT DOCUMENTS 5,351,772 * 10/1994 Smith ..... 175/428
5,486,137 * 1/1996 Flood et al. ..... 451/540
5,590,728 * 1/1997 Matthias et al. ..... 175/432
6,026,919 * 2/2000 Thigpen et al. ..... 175/432
6,077,591 * 6/2000 Griffin ..... 428/172

* cited by examiner

*Primary Examiner*—David Bagnell
*Assistant Examiner*—Zakiya Walker
(74) *Attorney, Agent, or Firm*—Gregory M. Luck; Sankey & Luck L.L.P.

(57) ABSTRACT

An improved cutting element is disclosed. The cutting element has a disc-shaped body with a front face and a backside. A ring portion formed on the front face extends around a raised central protrusion in formation of a vertical ridge. A plurality of inwardly extending, straight radial slots are formed in the raised central portion and create a plurality of vertical ridge segments. A super-abrasive compound, such as synthetic diamond, is applied to the front face. To aid in stress relief, the ridges have curved corners.

11 Claims, 8 Drawing Sheets

FIG. 14
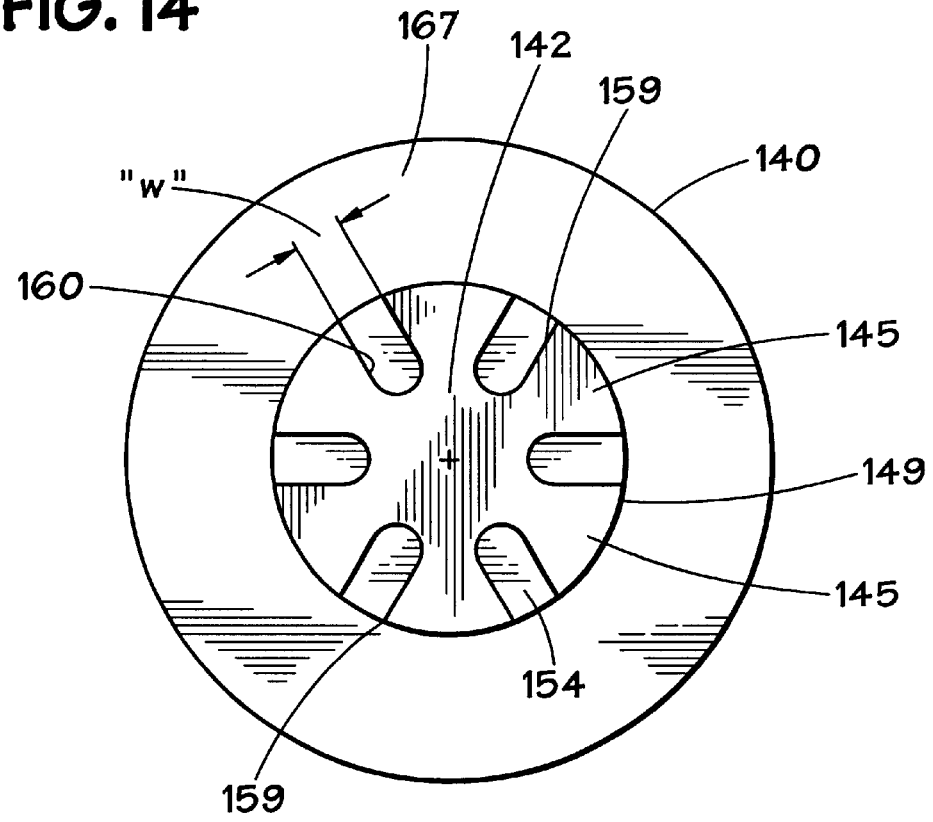
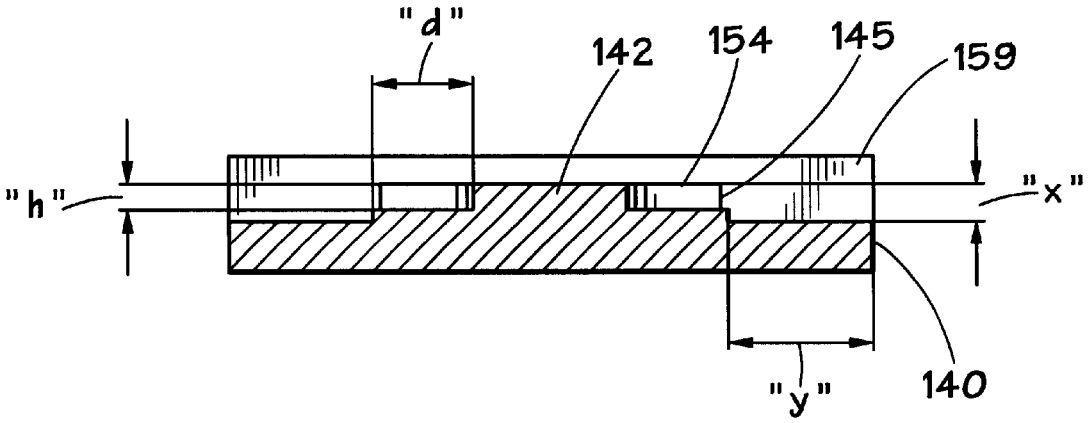
FIG. 15

FIG. 16
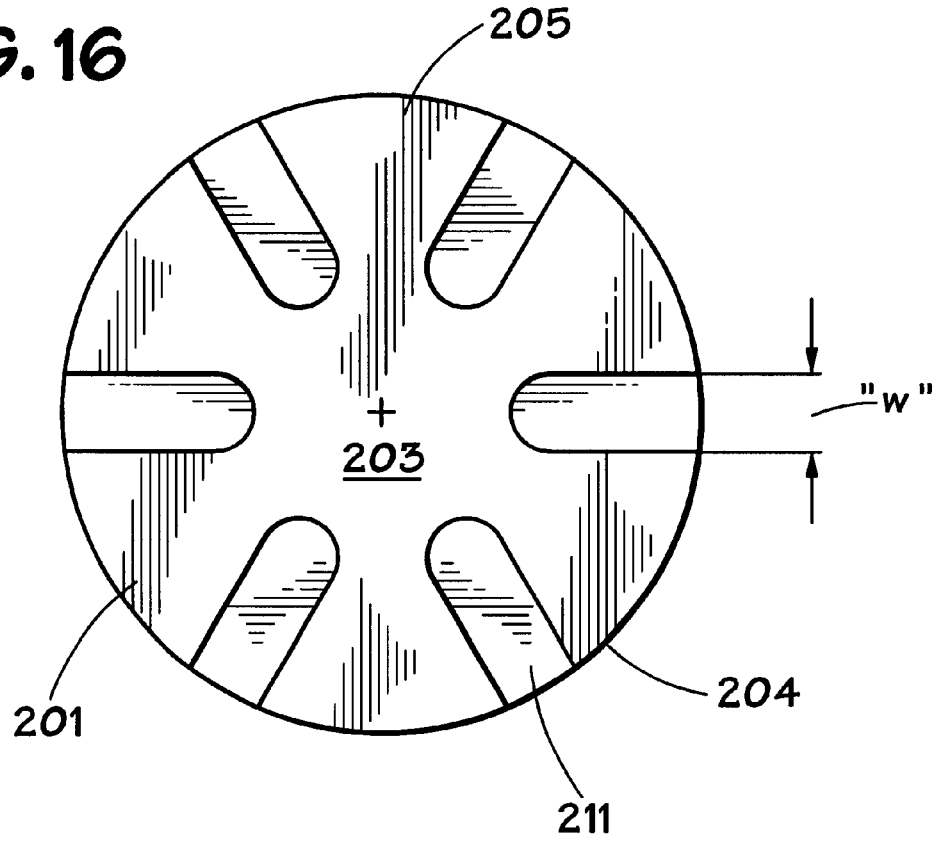
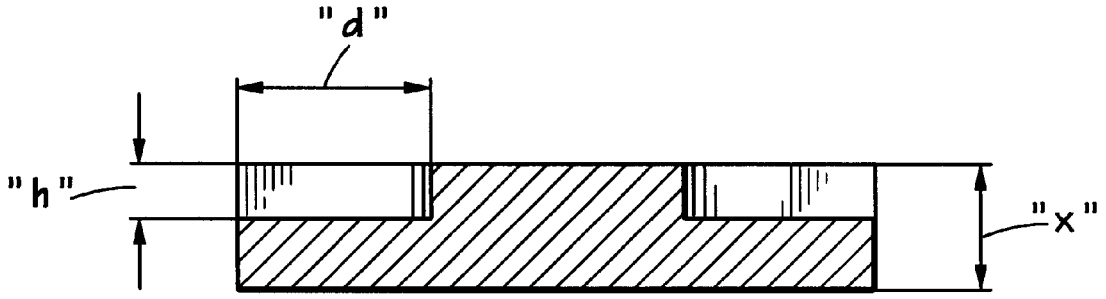
FIG. 17

CUTTING ELEMENT WITH STRESS REDUCTION

CROSS-REFERENCE TO RELATED APPLICATIONS

This application is a continuation-in-part of co-pending application Ser. No. 09/129,179 filed on Apr. 16, 1998, now U.S. Pat. No. 6,026,919 .

BACKGROUND OF THE INVENTION

1. Field of the Invention

The present invention generally relates to abrasive cutters useful in creating subterranean boreholes. More specifically, the present invention is directed to a compact cutter having superior impact resistance by having reduced residual stress.

2. Description of the Prior Art

Polycrystalline diamond compacts (PDC) are commonly used in oil field drilling and machine tools. A PDC is a synthetic form of diamond that is made by pressing diamond powder and cobalt onto a cemented tungsten carbide substrate. In the press, the cobalt becomes liquid and acts as a catalyst for diamond grain growth. The result is a highly abrasive, e.g. roughly 90% as abrasive as natural diamond, and environmentally resistant component which is very adaptable to drilling systems for resistant rock formations.

Although PDC is resistant to abrasion and erosion, a PDC compact cutter demonstrates several disadvantages. The main components of the PDC system, diamond and tungsten carbide, are brittle materials subject to impact fracturing. Moreover, because tungsten carbide and diamond have different coefficients of thermal expansion, there are residual stresses in a PDC system because the tungsten carbide demonstrates greater contraction during the cooling phase than that of the synthetic diamond.

As a result of the afore referenced disadvantages, attempts have been made in the art to limit the affects by modifying the geometry at the interface between the diamond and the tungsten carbide. Such modifications have usually taken the place of an irregular, non planar interface geometry. The most beneficial resultant of the non-planar interface, defined as any design where the interface between the diamond and tungsten carbide is not a circular plane, is the redistribution of residual stresses. Redistributing residual stresses allow the PDC manufacturer to increase the diamond thickness, thereby providing increased wear resistance. An irregular interface is advantageous since brittle materials are more resistant to compressive loads than tensile loads. The existence of a flat interface causes tensile stress plane between the diamond and tungsten carbide. This plane generally defines a main failure locus for delamination of the diamond layer.

One cutter which first utilized a non-planar interface geometry was the "Claw" cutter, so named as a result of the wear pattern of a worn cutter which looked like the remnants of claw marks. The interface of the "Claw" cutter, when viewed in cross section, consists of a plurality of parallel ridges and grooves disposed across the diameter. The "Claw" cutter provided advantages in the areas of wear resistance, but demonstrated a number of disadvantages which included the need to orient the cutter in order to position the parallel diamond inserts normal to the cutting surface. This required orientation of the cutter vis-a-vis the drill bit body complicates the manufacture process.

The so called "Ring Claw" cutter adopted a similar design to that of the Claw cutter except that the Ring Claw included a enhanced thickness ring of synthetic diamond which bounded a series of parallel inserts which also includes diamond of an enhanced thickness. The Ring Claw cutter demonstrated improved wear resistance over the Claw cutter, but when the outer diamond ring became worn, demonstrated similar disadvantages as to the need for precise orientation vis-a-vis the work surface.

Another prior art cutter is colloquially known as the "target cutter", and is characterized by an alternating grooves and ridges formed on the cutting face in the form of a target. The target cutter, while addressing the issue of orientation presented by the "Ring Claw cutter," demonstrated vulnerability to hoop stresses. Hoop stresses are created on the bounding ridges of tungsten carbide positioned interior to grooves filled with synthetic diamond. Hoop stresses are caused by uninterrupted concentric grooves and ridges in the PDC. During cooling of the PDC after pressing, the tungsten carbide ridges will contract and compress on the synthetic diamond rings disposed in the internal grooves. Such contraction simultaneously pulls the tungsten carbide substrate away from diamond disposed in external rings. These differential stresses create a tensile load between all of the internal tungsten carbide ridges and synthetic diamond disposed in all external grooves. such stresses can be severe enough to completely delaminate the synthetic diamond layer. A more common failure is the creation of stress zone in the interface, where friction due to impact can originate.

SUMMARY OF THE INVENTION

The present invention addresses the above and other disadvantages of prior cutter designs by providing a tool insert comprising a disc-shaped abrasive compact having major flat surfaces on each of opposite sides thereof, at least a part of the periphery of the margin flat surfaces providing a cutting edge.

In a preferred embodiment, the insert is comprised of a hard metal substrate bonded to abrasive compact material, e.g synthetic diamond, where the substrate defines an alternating set of at least partially interlocking ridges and grooves radially and concentrically organized about the plane defined by the major flat surface, where said ridges extend into the abrasive material and where said abrasive material extends into said grooves to form an interlocking interface.

The present invention offers a number of advantages over the prior art. One such advantage is a reduction in residual stress zones as a result of the interlocking radial and concentric grooves and ridges. These radial ridges and grooves serve to interrupt hoop stresses which traditionally consist of fractures propagated circumferentially through the interface, many times sheering the abrasive material from the substrate.

The present invention also serves to minimize failures occasioned as a result of differential expansion coefficients between the abrasive material and the underlying substrate during the cooling phase.

Further, the cutter of the present invention facilitates drill bit manufacture since the cuter can be oriented at any angle on the drill bit body during assembly.

The cutter also presents a uniform thickness of abrasive material around the circumference of the cutter with relative radial symmetry.

BRIEF DESCRIPTION OF THE DRAWINGS

FIG. 14 is a top view of yet another embodiment of the invention.

FIG. 15 is a side view of the embodiment illustrated in FIG. 14.

FIG. 16 is a top view of another embodiment of the invention.

FIG. 17 is a side view of the embodiment illustrated in FIG. 16.

DETAILED DESCRIPTION OF THE PREFERRED EMBODIMENTS

Figure 1:
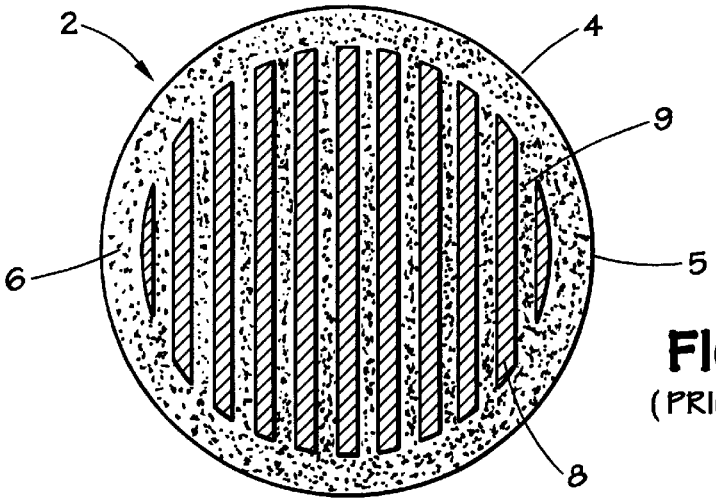
FIG. 1 (PRIOR ART)
FIG. 1 is a top, cross sectional view of a prior art, "ring-claw" cutter.
Figure 2:
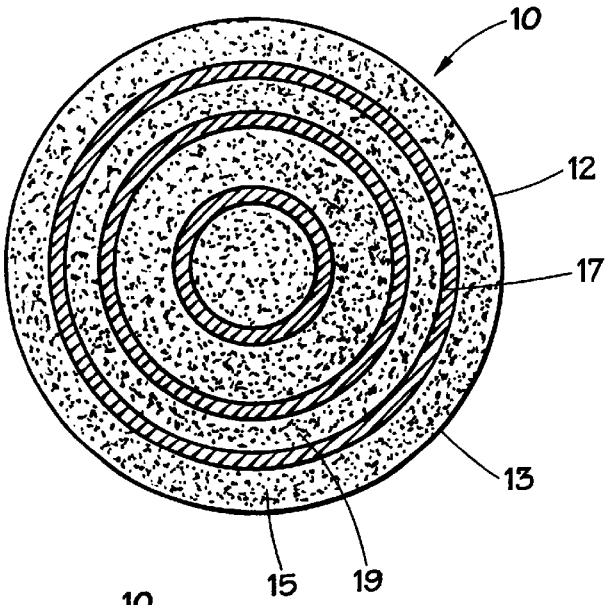
FIG. 2 (PRIOR ART)
FIG. 2 is a top, cross sectional view of a prior art, "target" cutter.

FIGS. 1 and 2 illustrate top, cross-sectional views of prior art cutters sold, in the instance of FIG. 1, under the name "ring claw cutter" and in the instance of FIG. 2, under the name "target cutter".

By reference to FIG. 1, the "ring claw" cutter 2 comprises a disc shaped body 4 defining a peripheral cutting edge 5 bounding a top, cutting surface 6 comprised of a superabrasive material, commonly polycrystalline diamond. As illustrated, the polycrystalline cutting surface 6 is bonded to an underlying hard metal substrate, e.g. cemented tungsten carbide, defining a series of axial ridges 8 bounded by grooves 9 about which the superabrasive is formed and subsequently bonded. The "ring claw" cutter is characterized by a radial groove formed at the outer periphery of body 4, which groove receives the polycrystalline diamond to form cutting edge 5, as shown.

FIG. 2 illustrates the prior art "target cutter" 10 which also includes a disc shaped body 12 defining a peripheral cutting edge 13 bounding a top cutting surface 15 again comprised of a polycrystalline diamond. In this prior embodiment, the carbide substrate forms a series of concentric ridges 17 defining complementary grooves 19 in which the polycrystalline diamond is formed and subsequently bonded.

Figure 3:
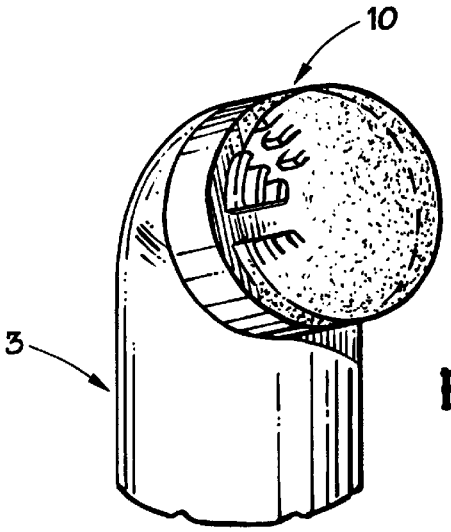
FIG. 3 is a perspective view of a stud cutter which may be affixed to a drill bit.

Both the "ring claw" and "target cutter" are typically bonded to a cemented carbide cutter to form a stud cutter. A perspective view of a stud cutter 3 as used with the "target cutter" 10 is illustrated in FIG. 3. In use, the stud cutter 3 is mounted in a drill bit in a known manner so that the cutting edge 13 is exposed and available to contact the surface to be drilled.

The "target" cutter embodiment suffers from problems of hoop stresses caused as a result of differential coefficients of expansion exhibited during cooling. These hoop stresses, in some cases, are severe enough as to result in delamination of the polycrystalline diamond layer. The "ring claw" cutter also requires orientation of axial ridges 8 prior to the cutter being mounted on the drill bit (not shown).

Figure 4:
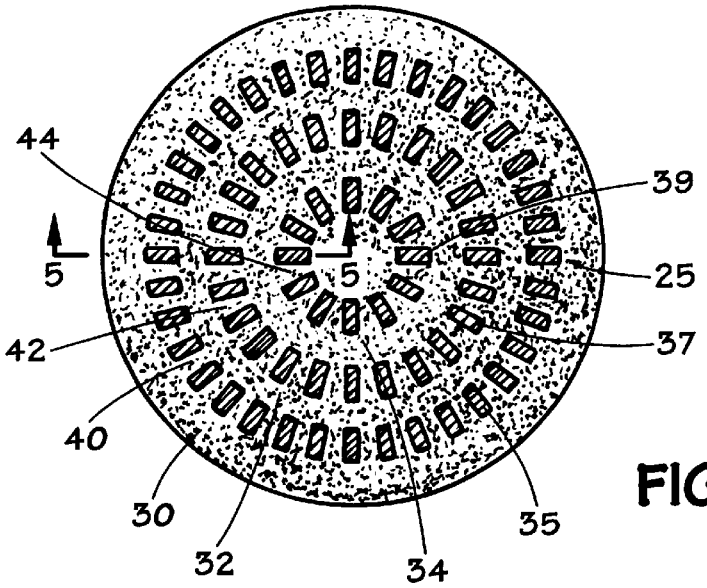
FIG. 4 is a top, cross-sectional view of one embodiment of the cutter of the present invention.
Figure 5:
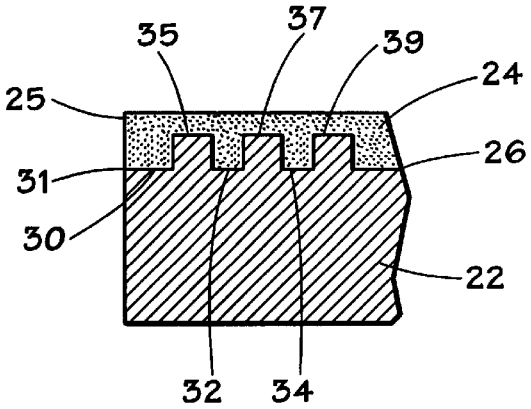
FIG. 5 is a side, cross-sectional view of the embodiment illustrated in FIG. 4.
Figure 6:
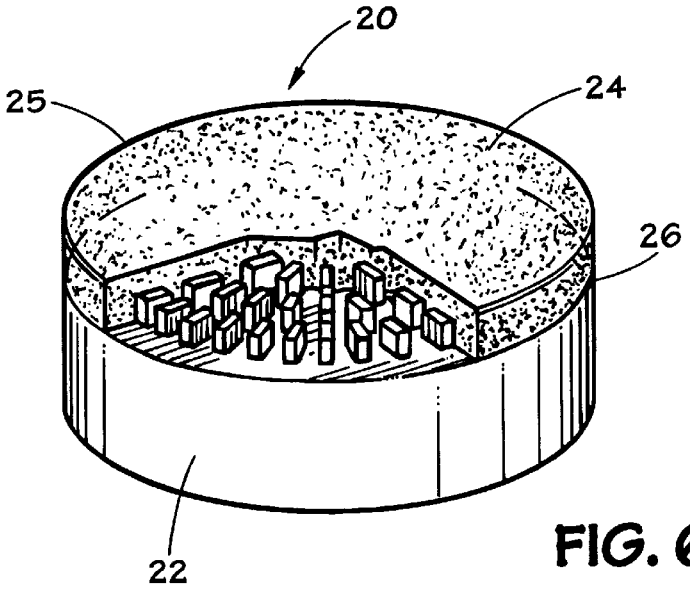
FIG. 6 is a perspective, cut-away view of the cutter illustrated in FIG. 4.

A first embodiment of the cutter of the present invention may be seen by reference to FIGS. 4–6. By reference to the Figures, the cutter 20 is comprised of a disc shaped body 22 defining a peripheral cutting edge 25. Body 22 provides a bonding substrate for a superabrasive material forming a cutting face 24. In a preferred embodiment, body 22 is comprised of a cemented tungsten carbide, while the superabrasive material is comprised of a synthetic, polycrystalline diamond. By reference to FIGS. 5 and 6, body 22 defines an interface 26 between the tungsten carbide and polycrystalline diamond layers which is characterized by an outer groove 30 formed in body 22 and defining at its outer extent said peripheral edge 25, which outer groove 30 bounding a series of inner, concentric grooves and ridges. In a preferred embodiment, outer groove may be between 0.020 and 0.050 inches in depth, as measured by the plane defined from the top of the substrate and along the longitudinal axis.

When viewed in cross section, concentric grooves 30, 32 and 34 are bounded by a series of concentric ridges 35, 37, and 39 formed in the tungsten carbide substrate. (See FIG. 5) Concentric grooves 30, 32 and 34 are intersected at regular intervals by a series of radial grooves 40, 42, and 44 formed through concentric ridges 35, 37, and 39 as illustrated. Radial grooves 40, 42, and 44 are preferably symmetrically oriented about cutting face 24 so as to provide optimum stress relief during both manufacture of the cutter 20 and use in the field.

Body 22 is adapted to accept the superabrasive layer bonded thereto in a conventional process in which a diamond powder is mixed with cobalt and the combination is pressed on cemented tungsten carbide substrate. The geometry of the irregular interface is such that the resulting abrasive layer is thicker, or possesses greater depth when viewed along the longitudinal axis, at concentric grooves 30, 32 and 34 than along concentric ridges 35, 37, and 39. (See FIG. 5) In such a fashion, difficulties associated with both stress relief and differential expansion coefficients are realized. In the same fashion, the thickness or depth of the superabrasive layer is also thicker at radial grooves 40, 42, and 44 than atop ridges 35, 37, and 39, though the thickness of this layer need not be the same as for grooves 30, 32, and 34 or even the same for each other.

In a preferred embodiment, the thickness of the superabrasive layer at each of concentric grooves 30, 32, and 34, when viewed along the longitudinal axis, is between 0.050 and 0.100 inches. The thickness of superabrasive layer at radial grooves 40, 42, and 44 is between 0.050 and 0.100 inches, though thickness of at least 0.25 inches are contemplated within the spirit of the invention for this and other embodiments. The thickness of the abrasive layer atop ridges 35, 37, and 39 is between 0.030 and 0.050 inches.

The preferred distance between the peripheral cutting edge 25 and the bottom 31 of outer groove 30 is between 0.010 and 0.100 inches. Although the aforedescribed dimensions are preferred, other dimensions are also contemplated within the spirit of the present invention.

Figure 7:
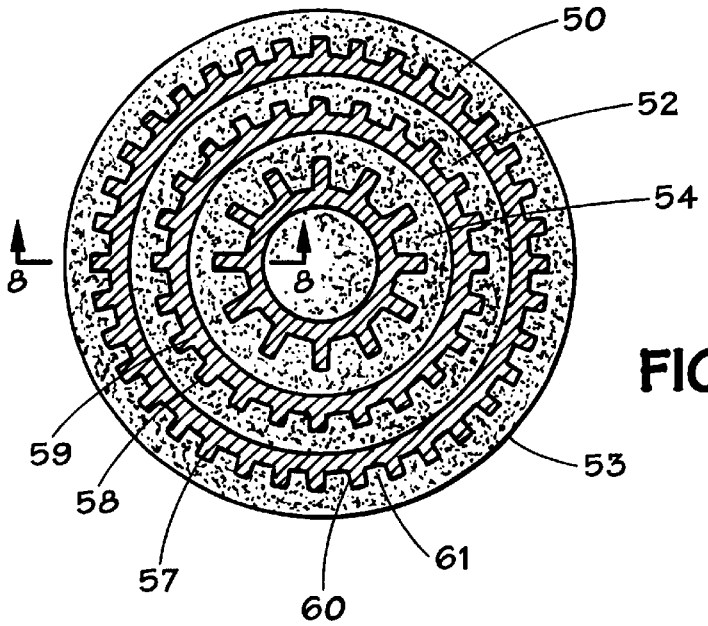
FIG. 7 is a top, cross-sectional view of a second embodiment of cutter of the present invention.
Figure 8:
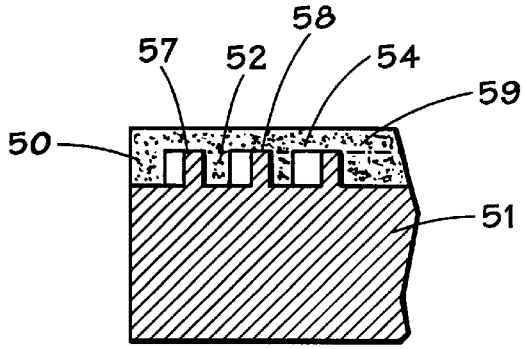
FIG. 8 is a side, cross-sectional view of the embodiment illustrated in FIG. 7.
Figure 9:
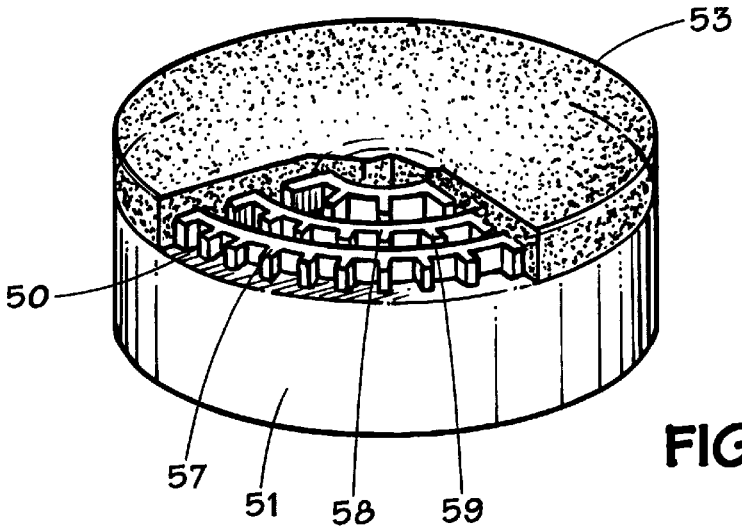
FIG. 9 is a perspective, cut-away view of the embodiment illustrated in FIG. 7.

A second embodiment of the present invention is illustrated at FIGS. 7–9. In this embodiment, a series of concentric grooves 50, 52 and 54 are concentrically disposed on the upper face of a disc shaped body 51, with the outer groove 50 disposed within the peripheral cutting edge 53 of body 51. In this embodiment, concentric grooves 50, 52 and 54 are bounded by a series of concentric ridges 57, 58, and 59, with the first or outermost such ridge 57 formed at the inner diametrical extent of outer groove 50. It is preferred that this embodiment include at least two but no more than five said grooves, three being illustrated. In conjunction with this embodiment, it is preferred that the thickness of the superabrasive layer of at least the outer groove 50 be between 0.050 and 0.100 inches, when taken along the longitudinal axis. It is also preferred that the superabrasive layer maintain a thickness of between 0.030 and 0.050 inches atop ridges 57, 58, and 59.

As illustrated, each ridge includes an elongate radial component, illustrated in FIG. 7 as 60, which components 60 are symmetrically aligned vis-a-vis other such components and also with respect to each ridge. As illustrated, each axial component preferably extends outwardly at least partially to the next outer ridge and defines a corresponding set of radial notches 61 in each bounding groove. (See FIG. 7) The radial length of each component 60 and corresponding notch 61 may vary. However, it is desired in conjunction with this embodiment, that said components 60 not extend to adjacent ridges. While this embodiment is illustrated as including a plurality of such radial elements 60 and corresponding notches 61, fewer or less such components may be used depending on the application. In conjunction with this embodiment, it is preferred that each concentric ridge include at least six but no more than thirty-six of said components 60. It is further contemplated that radial components 60 may be formed to the inner portion of each ridge.

In this embodiment, the outer diamond "ring" disposed in outer groove 50 must be sufficiently thin to allow the compressive effect of grooves 50, 52 and 54 to extend to the cutting face. In a preferred embodiment, the width of this outer diamond "ring", as measured radially from the cutting edge 53 to the adjacent ridge 57, is less than or equal to 0.050 inches.

Figure 10:
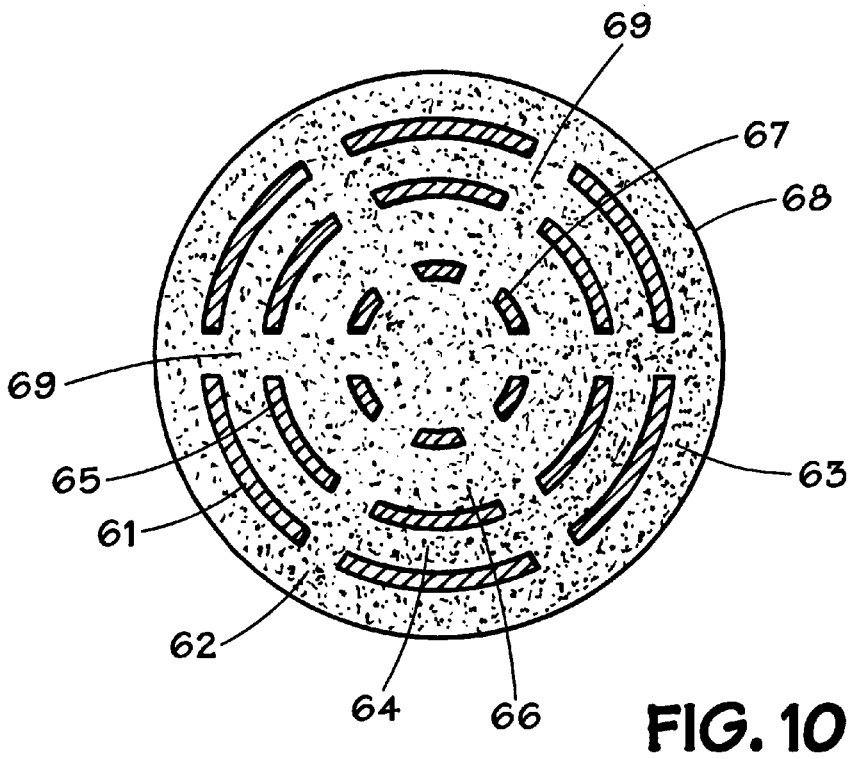
FIG. 10 is a top, cross-sectional view of a third embodiment of cutter of the present invention.
Figure 11:
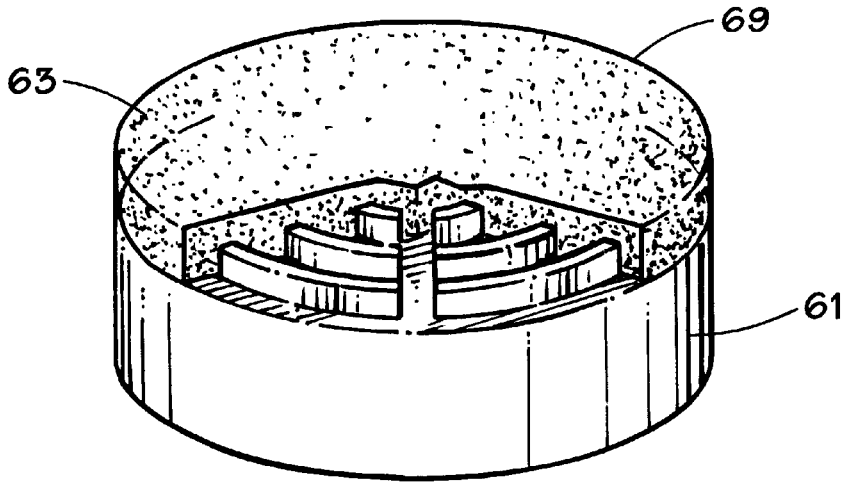
FIG. 11 is a perspective, cut-away view of the cutter illustrated in FIG. 10.

A third embodiment of the cutter of the invention is illustrated at FIGS. 10–11, and includes a disc shaped body 61 defining a plurality of concentric grooves 62, 64 and 66 bounded by radial ridges 61, 65, and 67. Body 61 may again be comprised of a cemented, tungsten carbide, and is adapted to receive a superabrasive material 63 such as a synthetic, polycrystalline diamond, to form a peripheral cutting edge 68.

In this embodiment, concentric grooves 62, 64 and 66 are intersected by a plurality of radially oriented grooves 69. In a preferred embodiment, grooves 69 run from the axis of the cutter to cutting edge 68, as illustrated. It is desired that grooves 69 be symmetrically distributed to form radial ridges of equal arc length and orientation vis-a-vis each other. In such a fashion, maximum stress relief may be realized. In this embodiment, the thickness of the polycrystalline layer at grooves 62, 64, and 66 may vary dependent on the radial distance from the longitudinal axis. In a similar fashion to that described above with respect to the embodiment of FIGS. 4–6, the thickness of polycrystalline diamond about grooves 62, 64, and 66 is preferably 0.050–0.100 inches, when received along the longitudinal axis. The thickness of polycrystalline diamond at ridges 61, 65, and 67 is preferably between 0.030 and 0.050 inches, although other thicknesses are also envisioned.

Figure 12:
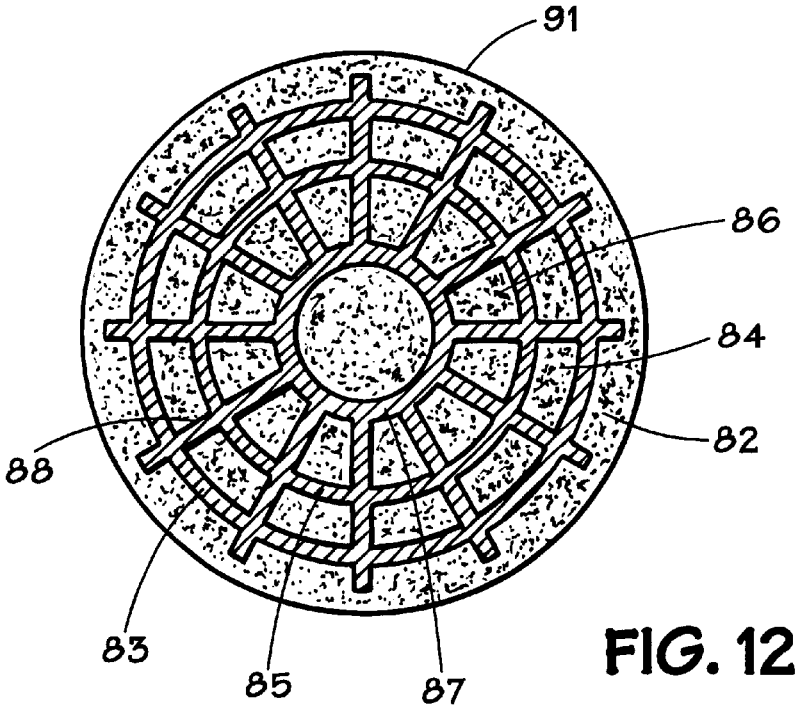
FIG. 12 is a top, cross-sectional view of a fourth embodiment of the cutter of the present invention.
Figure 13:
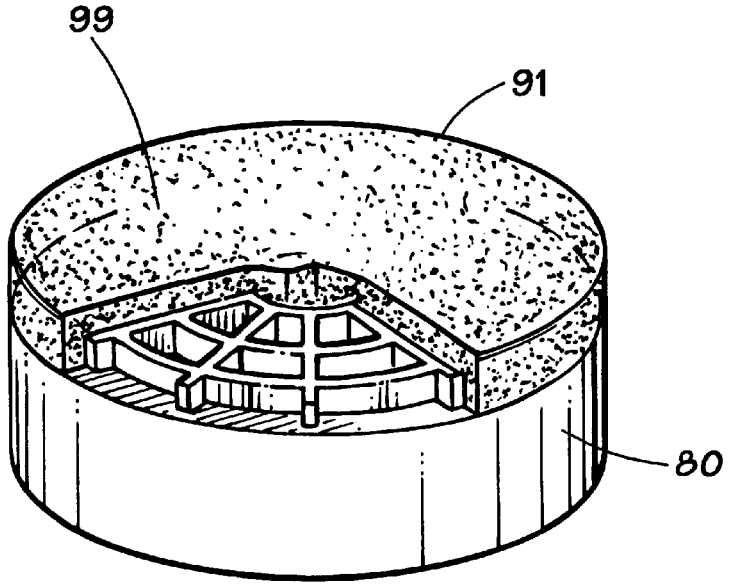
FIG. 13 is a perspective, cut-away view of the cutter illustrated in FIG. 12.

A fourth embodiment of the cutter of the invention is illustrated in FIGS. 12–13. In this embodiment, a disc shaped body 80 comprised of a hard metal, e.g. tungsten carbide, is provided about its face with a series of concentrically oriented grooves 82, 84 and 86, bounded by concentric ridges 83, 85, and 87. In this embodiment, outer ridge 83 is spaced a set distance from the peripheral cutting edge 91. Each of ridges 83, 85, and 87 are intersected by a series of radial segments 88 so as to join said ridges together in an integral structure, as illustrated. The combination structure is adapted to receive a superabrasive compound, e.g. synthetic polycrystalline diamond. As illustrated, segments 97 are preferably symmetrically disposed about cutting face 99 and extend slightly beyond outer ridge 83, but do not extend to cutting edge 91. In conjunction with this embodiment, it is contemplated that radial segments may vary in length dependent on the radial distance from said longitudinal axis.

In conjunction with this embodiment, it is preferred that the thickness of the superabrasive layer of at least the outer groove 82 be between 0.050 and 0.100 inches, when taken along the longitudinal axis. It is also preferred that the superabrasive layer maintain a thickness of between 0.030 and 0.050 inches atop ridges 83, 85, and 87.

FIGS. 14–15 illustrate yet another embodiment of the invention. In this embodiment, a disc-shaped body 140 comprised of a hard metal, e.g. tungsten carbide, is provided about its face with a radially centered protrusion 142 which is bounded by two or more radial ridges 145 so as to define a ring 167 and two or more slots or grooves 154. Slots define a given width "w." Slots may be formed to a depth "x" which is greater or less than the height of protrusion 142 when measured from the ring 167 along the longitudinal axis.

In a preferred embodiment, ridges 145 define flared terminal ends 149, as illustrated. It is also desired that grooves 154 be "u" shaped when viewed in top section along the longitudinal axis of body 140. It is desired that the comers 159 of ridges 145 be curved so as to aid in stress reduction. It is envisioned that ridges 145 may be of even or uneven length. It is further envisioned that the edges 160 bordering ridges 145 also be curved to further aid in stress relief. As illustrated, ring 167 describes a given radial width "y," where protrusion 142 describes a given height "h" above ring 167.

The aforementioned combination is adapted to receive a superabrasive compound, e.g. synthetic diamond 158, as illustrated and described above in relation to previous embodiments.

It has been discovered that optimum performance of the cutter may be achieved if the width, depth and height of groove 154 is determined as a function of several of the other large features of body 140. In the example illustrated in FIG. 14, groove 154 defines a height "h", a width "w" and a depth "d." It has been discovered that preferred wear characteristics are observed when the following relationships are present:

width of groove=25% to 200% of "y"

depth of groove=25% to 200% of "y"

height of groove=25% to 100% of "x"

To achieve improved performance characteristics, it is not necessary that all of these relationships be present in each cutter. In this connection, preferential performance may be observed when just one of these ratios is present in a given cutter. Another embodiment of the invention may be seen by reference to FIGS. 16–17. In this embodiment, a disc shaped body 201 comprised of a hard metal, e.g. tungsten carbide, is provided about its face with a radially centered protrusion 203 which is bounded by a plurality of radial ridges 205 which in turn define a plurality of slots or grooves 211. Unlike the embodiment of FIGS. 14–15, ridges 205 extend to the periphery 204 of body 201.

In this embodiment, body 201 defines a total height "x" when viewed in cross-section (See FIG. 17). Slots 211 each define a width "w," a depth "d" an a height "h", where one or more of three variables may be expressed as a function of the height "x" of body 201 as follows:

width of groove=25% to 200% of "x"

depth of groove=25% to 200% of "x"

height of groove=25% to 100% of "x"

Figure 18:
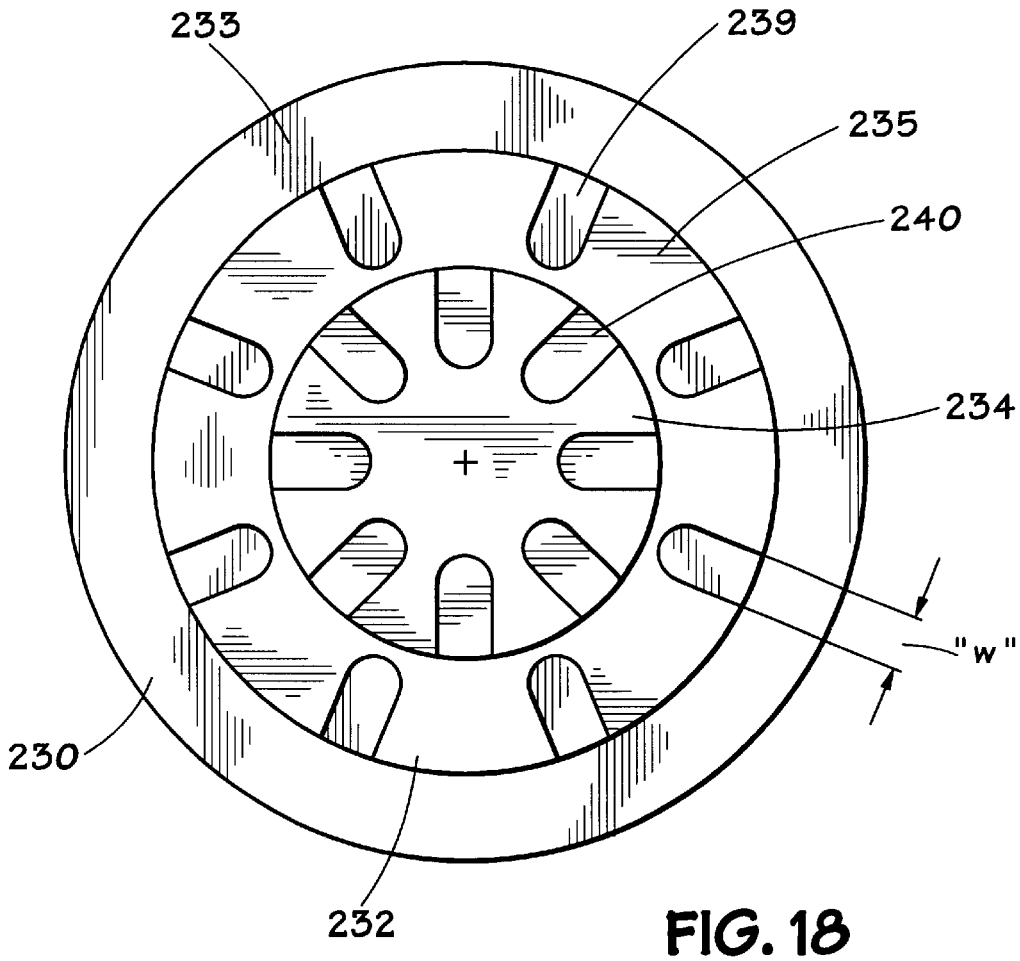
FIG. 18 is a top view of another embodiment of the invention.
Figure 19:
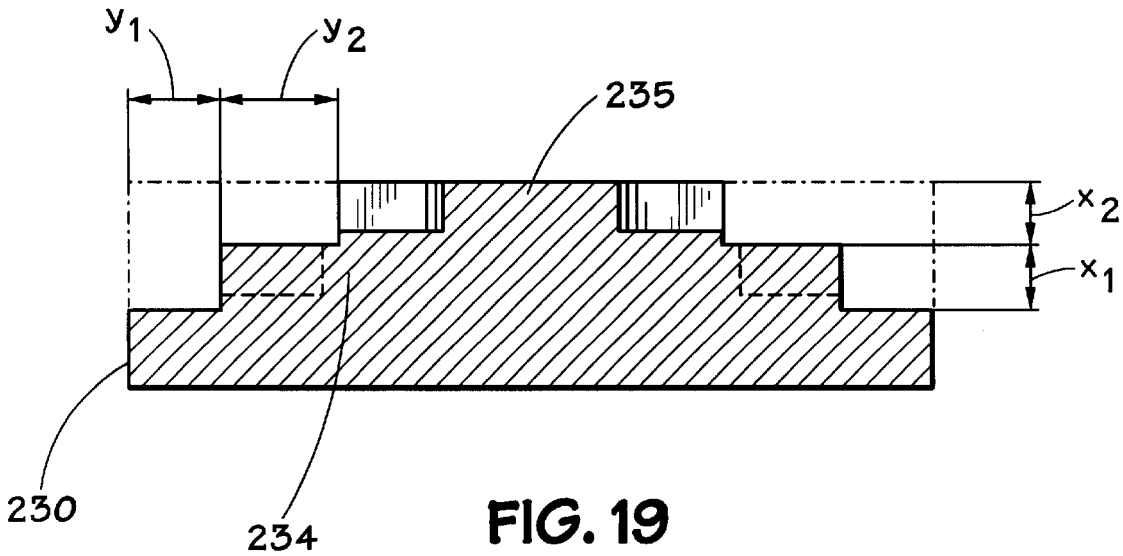
FIG. 19 is a side view of the embodiment illustrated in FIG. 18.

Yet another embodiment of the invention may be seen by reference to FIGS. 18–19. In this embodiment, a disc shaped body 230 is provided about its face with two or more concentric and radially centered protrusions 232 and 234, so as to define two or more rings 233 and 235, as illustrated. A series of radial grooves or slots 239 and 240 are formed in said protrusions 232 and 234 so as to define a series of radial ridges 241.

Protrusions 232 and 234 define a height $x_1$ and $x_2$ respectively, where the respective rings 233 and 235 also defines a depth $y_1$ and $y_2$. As expressed above in relation to the embodiments of FIGS. 14–17, the width, depth and height of grooves 239 formed in each protrusion are preferably expressed as a function of the dimensions of the major features of the cutter body 230:

width of groove one (239)=25% to 200% of "$y_1$"

depth of groove one (239)=25% to 200% of "$y_1$"

height of groove one (239)=25% to 100% of "$x_1$"

width of groove two (240)=25% to 200% of "$y_2$"

depth of groove two (240)=25% to 200% of "$y_2$"

height of groove two (240)=25% to 100% of "$x_2$"

With respect to the embodiments of FIGS. 16–19, it is also desirable to form the hard metal body to minimize sharp angulations. In this connection, it is again desired that the grooves be "u" shaped and that other edges and comers be configured to otherwise aid in stress relief.

Although particular detailed embodiments of the apparatus and method have been described herein, it should be understood that the invention is not restricted to the details of the preferred embodiment. Many changes in design, composition, configuration and dimensions are possible without departing from the spirit and scope of the instant invention.

What is claimed is:

1. A cutter having a front surface defining a cutter face, said cutter comprising:

a disc shaped body having an interface surface on one side bounded by an outer perimeter edge;

said interface surface including a peripheral annular ring surface portion defined between the outer perimeter edge and an inner raised circular edge spaced radially inward from the perimeter edge, a protrusion surface portion inside the peripheral annular ring surface portion, and a plurality of finger-shaped slots formed in the protrusion surface portion to extend radially inward from the inner raised circular edge and create a series of ridges between the slots;

said peripheral annular ring surface portion being disposed a distance (x) below the uppermost level of the protrusion surface portion and the slots being of a given height (h) below the uppermost level of the protrusion surface portion, which is less than the distance (x) of the peripheral annular ring surface portion, so as to define the inner raised circular edge;

said peripheral annular ring surface portion being of radial width (y) established by the inward spacing of the inner raised circular edge from the outer perimeter edge;

each of said slots also has a given width dimension (w) and a given depth dimension (d), such that slot width (w) is 25% to 200% of the radial width (y) of the peripheral annular ring surface portion; and a superabrasive material bonded to said body at said interface surface to create a cutting surface on said front cutter face having a greater thickness of said superabrasive material over the peripheral annular ring surface portion and over each radial slot.

2. The cutter of claim 1 where said depth dimension (d) of said slots is 25% to 200% of the radial width (y).

3. The cutter of claim 1 where said height dimension (h) of said slots is 25% to 100% of the distance (x).

4. The cutter of claim 1 where the terminal ends of the ridges are flared.

5. The cutter of claim 1 where the ridges defines curvilinear contact surfaces with the superabrasive material.

6. The cutter of claim 1 where the superabrasive material is polycrystalline diamond.

7. A cutter having a front surface defining a cutter face, said cutter comprising:

a disc shaped body having a multi-tiered interface surface on one side bounded by an outer perimeter edge, said multi-tiered interface surface including a first peripheral surface portion defined as a first annular ring, the first peripheral annular ring surface portion defined between the outer perimeter edge and a first inner raised circular edge spaced radially inward from the perimeter edge;

a first protrusion surface portion defined inside the first peripheral annular ring surface portion with the first protrusion surface portion, the first protrusion surface portion rising a distance ($x_1$) above the first peripheral annular ring surface portion and including the first inner raised circular edge so as to define a radial width ($y_1$) for the first peripheral annular ring surface portion that is established by the inward spacing of the first inner raised circular edge from the outer perimeter edge, the first protrusion surface portion also providing a second peripheral surface portion defined as a second annular ring defined between the first inner raised circular edge and a second inner raised circular edge spaced radially inward from the first inner raised circular edge;

a plurality of radial slots formed in the first protrusion surface portion to extend radially inwardly from the first peripheral annular ring surface portion and create a series of ridges between the slots, each of said slots having width ($w_1$), depth ($d_1$), and height ($h_1$) dimensions which are a function of the distance ($x_1$) of the first protrusion surface portion above the first peripheral annular ring surface portion and the radial width ($y_1$) of the first peripheral annular ring surface portion;

a second protrusion surface portion defined inside the second peripheral annular ring surface portion, the second protrusion surface portion rising a distance ($x_2$) above the second peripheral annular ring surface portion and including the second inner raised circular edge so as to define a radial width ($y_2$) for the second peripheral annular ring surface portion that is established by the inward spacing of the second inner raised circular edge from the first inner raised circular edge, a plurality of radial slots formed in the second protrusion surface portion to extend radially inwardly from the second peripheral annular ring surface portion and create a series of ridges between the slots, each of said slots having width ($w_2$), depth ($d_2$), and height ($h_2$) dimensions which are a function of the distance ($x_2$) of the second protrusion surface portion above the second peripheral annular ring surface portion and the radial width ($y_2$) of the second peripheral annular ring surface portion; and a superabrasive material bonded to said body at said interface surface.

8. The cutter of claim 7 where the width and depth of the slots in the first protrusion surface portion is between 25 and 200 percent of the radial width ($y_1$) of the first peripheral annular ring surface portion.

9. The cutter of claim 7 where the height of the slots in the first protrusion surface portion is between 25 and 100 percent of the distance ($x_1$).

10. The cutter of claim 7 where the width and depth of the slots in the second protrusion surface portion is between 25 and 200 percent of the radial width ($y_2$) of the second peripheral annular ring surface portion.

11. The cutter of claim 7 where the height of the slots in the second protrusion surface portion is between 25 and 100 percent of the distance ($x_2$).

* * * * *